US005520278A

United States Patent [19]

Hughes

[11] Patent Number: 5,520,278

[45] Date of Patent: May 28, 1996

[54] CONTAINER CONTENT OR ARTICLE MARKING DEVICE

[76] Inventor: D. Michael Hughes, Broken Arrow Ranch, Ingram, Tex. 78025

[21] Appl. No.: 524,764

[22] Filed: Sep. 7, 1995

Related U.S. Application Data

[63] Continuation-in-part of Ser. No. 278,150, Jul. 21, 1994, abandoned.

[51] Int. Cl.[6] ..... G09F 3/00

[52] U.S. Cl. ..... 206/217; 206/459.5; 40/299

[58] Field of Search ..... 206/459.5, 459.1, 206/216, 217; 40/299, 310, 311, 331, 324

[56] References Cited

U.S. PATENT DOCUMENTS

| | | | |
|---|---|---|---|
| 2,219,834 | 10/1940 | Davis | 40/324 |
| 2,245,964 | 6/1941 | Cronenwett | 40/310 |
| 2,540,718 | 2/1951 | Duskin | 40/299 |
| 3,072,246 | 1/1963 | Goldstein | 40/310 |
| 3,315,386 | 4/1967 | Kest et al. | 40/2 |
| 3,355,830 | 12/1967 | Hoffman | 40/310 |
| 4,054,105 | 10/1977 | Fegan | 116/129 T |
| 4,092,191 | 5/1978 | Jones | 156/64 |
| 4,108,103 | 8/1978 | Ammar | 116/116 |
| 4,352,253 | 10/1982 | Oswalt | 40/300 |
| 4,389,963 | 6/1983 | Pearson | 116/308 |
| 4,589,685 | 5/1986 | Lazar | 283/81 |
| 4,752,087 | 6/1988 | Weisbach | 283/67 |
| 5,240,755 | 8/1993 | Zimmer | 40/299 X |

*Primary Examiner*—Jacob K. Ackun
*Attorney, Agent, or Firm*—Robert A. McFall

[57] ABSTRACT

A device for selectively indicating a characteristic of an article or of the contents of a container includes a body having a plurality of predefined indicator marks placed thereon, and a means associated with each one of the indicator marks by which the device can be selectively attached to the container or article. The placement of the attachment means is such that the attachment point of the indicating device 10 is unambiguously associated with only a single one of the indicator marks 14.

4 Claims, 3 Drawing Sheets

CONTAINER CONTENT OR ARTICLE MARKING DEVICE

This application is a continuation-in-part of application Ser. No. 08/278,150, filed Jul. 21, 1994 now abandoned.

TECHNICAL FIELD

This invention relates generally to a device for selectively indicating a characteristic such as the specific contents of a container or condition of an article, and more particularly to such a device having a plurality of indicants and a separate means associated with each indicant for attaching the device to the container or article.

BACKGROUND ART

Around the home, garage, farm or ranch, there has been a long-felt need for a simple and effective device to identify the contents of a can or bottle. For example, does a gas can contain regular gas or a gas-oil mixture? If a mixture, is it 20:1 or 50:1? If a can or tank contains a previously mixed chemical used in farming or gardening, is it fertilizer, herbicide, pesticide, fungicide, or something else? With respect to engines or motors that use different weight oil in different seasons of the year, is the current oil 10 weight, 30 weight, or multi-viscosity, and when is it due for change?

Thus, it can be readily appreciated that there are numerous situations, often occurring daily, that require accurate identification of the contents of a container. If the contents of a container are misidentified the consequences could, at the very least, be bothersome, and at the worst, catastrophic.

Furthermore, temporarily marking a container with pen, chalk, crayon, etc. is not good practice. For example, the contents of the container may be changed, but the prior contents indication may still be observable. Stick-on labels or tape can become detached or unreadable.

The present invention is directed to overcoming the problems set forth above. It is desirable to have a simple and inexpensive device for selectively identifying the contents of a container or a specific condition of an article. Specifically, it is desirable to have such a device that by the very position at which it is attached to a container or article will, by and in itself, readily identify what is in the container or status of the article.

Importantly, it is also desirable to have a device for indicating one or more characteristics of a container or article that can be selectively reattached in a different position if either the contents of the container change or if the device itself is moved to a container having contents different from that previously identified.

DISCLOSURE OF THE INVENTION

In accordance with one aspect of the present invention, a device for selectively indicating a characteristic of a container has a body portion having a plurality of indicants, or identifying marks, placed thereon, and a means associated with each of the indicants for selectively attaching the device to the container.

In accordance with another aspect of the present invention, a device for selectively indicating a characteristic of an article has a body portion having a plurality of indicants, or identifying marks, placed thereon, and a means associated with each of the indicants for selectively attaching the device to the article.

BEST MODE FOR CARRYING OUT THE INVENTION

Figure 1:
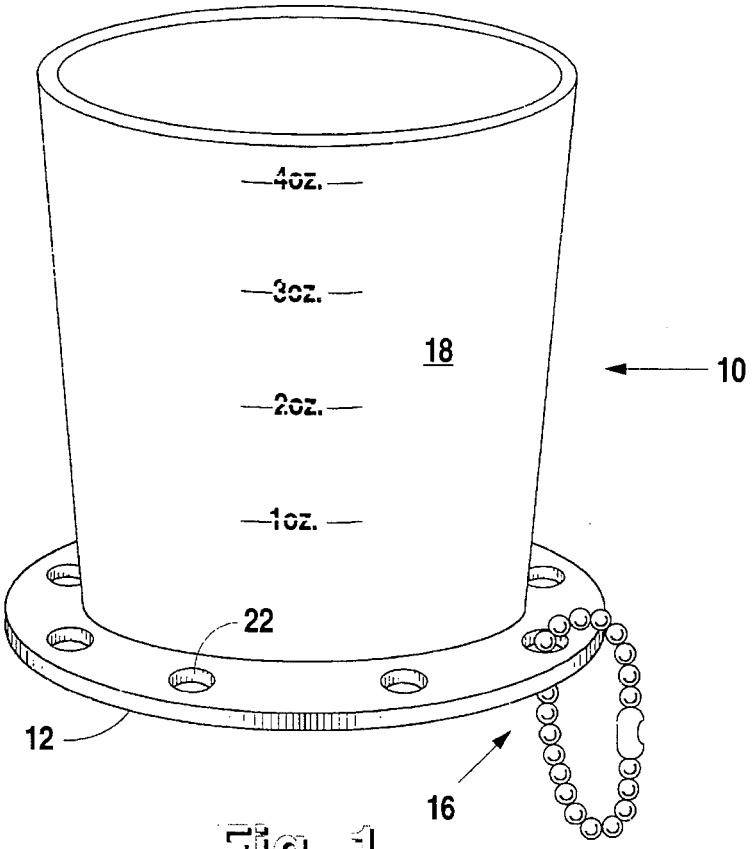
FIG. 1 is a perspective view of a device, embodying the present invention, for selectively indicating a characteristic of a container.

As shown in each of the drawings, a device, embodying the present invention, for selectively indicating a characteristic of a container, is generally identified by the reference number 10. The term "container", while not specifically shown in any of the drawings, is used herein in a broad sense and includes, by way of example but not limited to, bottles, cans, spray apparatuses, engines crankcases, and machines having fluid storage or collecting chambers such as hydraulic fluid supply tanks.

The indicating device 10 embodying the present invention includes a body portion 12 having a plurality of predefined indicants or identification marks 14 disposed thereon, and a means 16 associated with each of the indicants 14 for selectively attaching the device 10 to the container.

Figure 2:
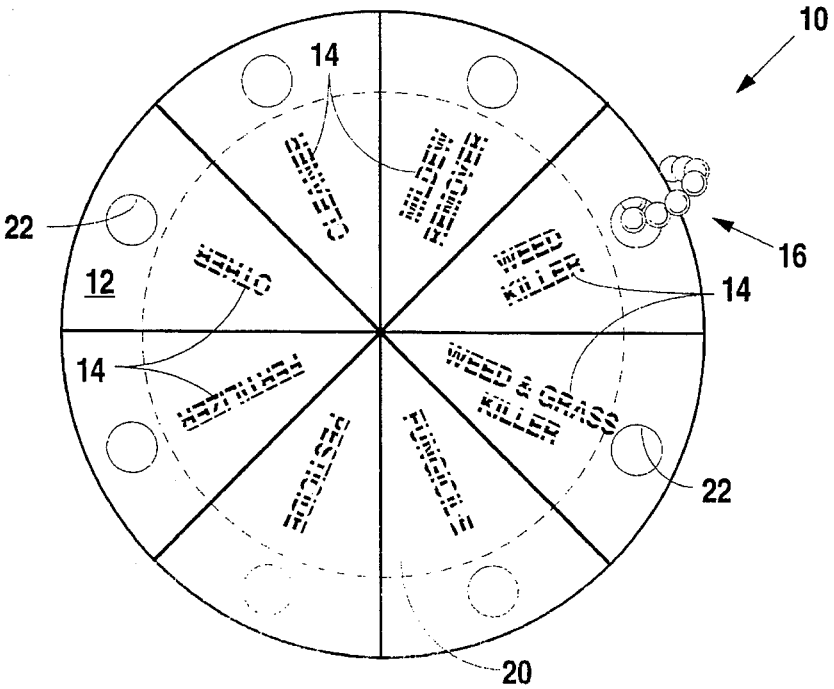
FIG. 2 is a bottom view of the device of FIG. 1, showing the indicating marks and means by which the device is attached to a container.

In the preferred embodiment of the present invention, shown in FIGS. 1 and 2, the indicating device 10 is an integral part of a volumetric measuring device, such as a measuring cup 18. The indicating device 10 actually forms the base of the cup and has a rim, or flange extending radially outwardly from the cup base. Preferably the cup and flange are formed of a molded plastic material, such as polyethylene or polycarbonate, and the indicants 14, for example as shown in FIG. 2, are raised letters or symbols that are formed on the bottom of the indicating device 10 during the molding process. Alternatively, the indicating marks 14 may be stamped, painted, etched, scribed, attached by adhesive, or otherwise placed upon the indicating device 10. Also, if desired, the indicating device 10 may be molded or formed separately and then assembled, such as by snapping together mating grooves and ridges provided on the indicating device 10 and the measuring device 18.

By way of illustration, the indicants 14 shown in FIG. 2 appropriately identify various concentrated liquid or granulated materials that are typically mixed with water prior to use around a home, garden, farm or ranch. Quite often, not all of the mixed solution is used, and rather than 'dumping' the leftover mixture, it is frequently stored, either in its dispensing container such as a sprayer, or in the mixing container. After a few days, if not properly marked, it is not uncommon for one to be less than certain what is in the container. The present invention overcomes this problem.

Each of the indicants 14 are positioned within a respective predefined surface area 20 which, in the illustrative example shown in FIG. 2, is in the form a pie-shaped segment. Importantly, each of the predefined surface areas 20 having a respective one of the indicants 14 placed thereon, has a separate one of the means 16 for selectively attaching the device 10 to a container. In this example, the means 16 is an aperture 22 extending through each of the pie-shaped segments 20. A conventional tie member, such as the ball-snap key chain shown in FIGS. 1 and 2, or alternatively, a wire twist tie, a plastic tie, or similar tie may be inserted through the aperture 22 associated with the indicant 14 that correctly corresponds with the contents of a container, and then attached, or fastened to the handle, nozzle, or other part of the container. In this manner, the contents of the container can be readily ascertained by simply looking at the indicating device 10 and observing the identifying mark 14 next to the aperture 22 by which the device 10 is attached to the container.

Figure 3:
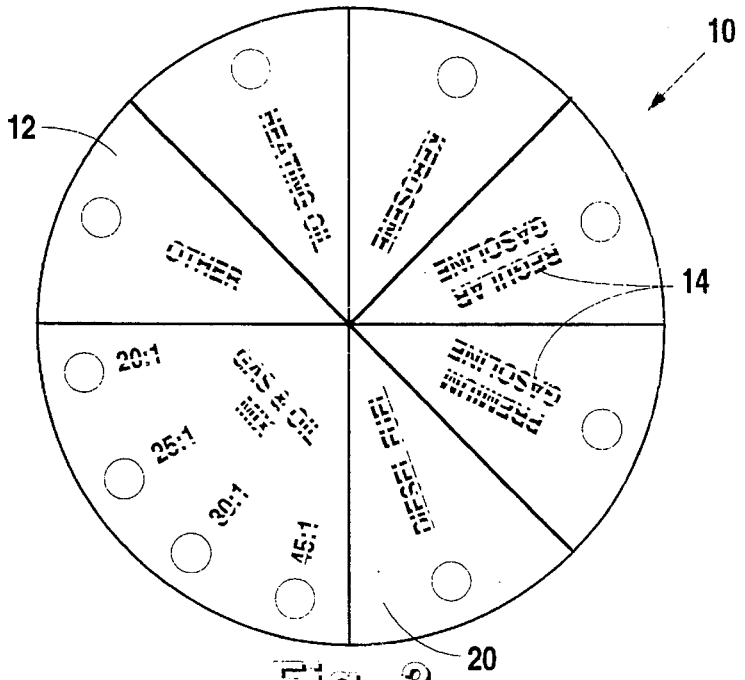
FIG. 3 is a plan view of the body portion of an alternate arrangement of the indicating device embodying the present invention.

An alternative arrangement of the indicants 14 placed on the indicating device 10 is shown in FIG. 3. In this arrangement, which may be used with either a volumetric measuring device 18 such as shown in FIG. 1, or with a flow control device such as a conventional funnel or nozzle, the indicants 14 identify various fuels and fuel mixtures. This arrangement is particularly useful when more than one type of fuel is used at the same location.

Figure 6:
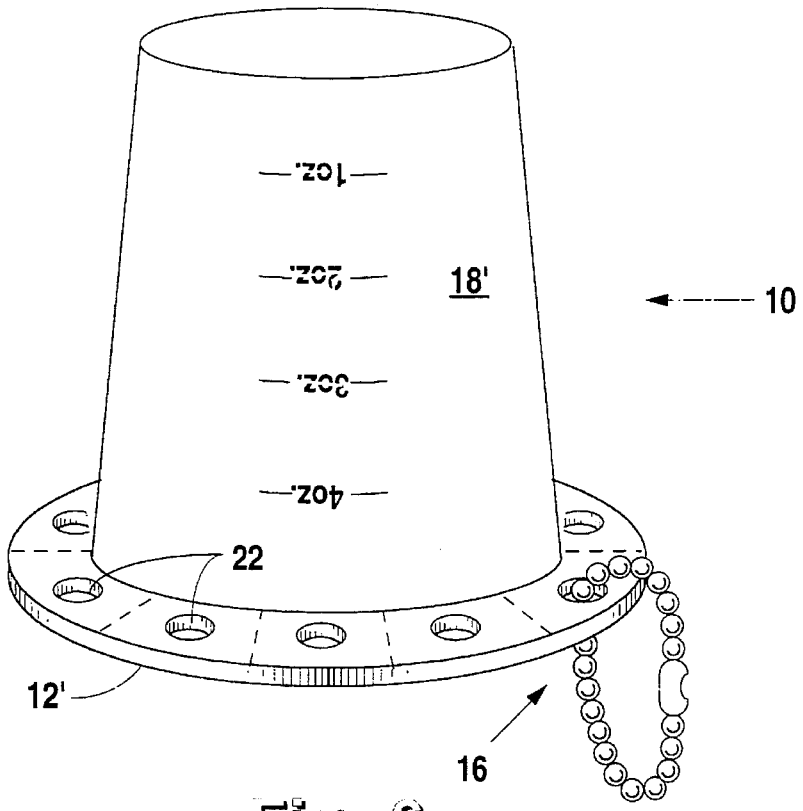
FIG. 6 is a perspective view of an alternative arrangement of the device embodying the present invention, as shown in FIG. 1, in which the measuring cup is removably attached to the body portion of the device.
Figure 7:
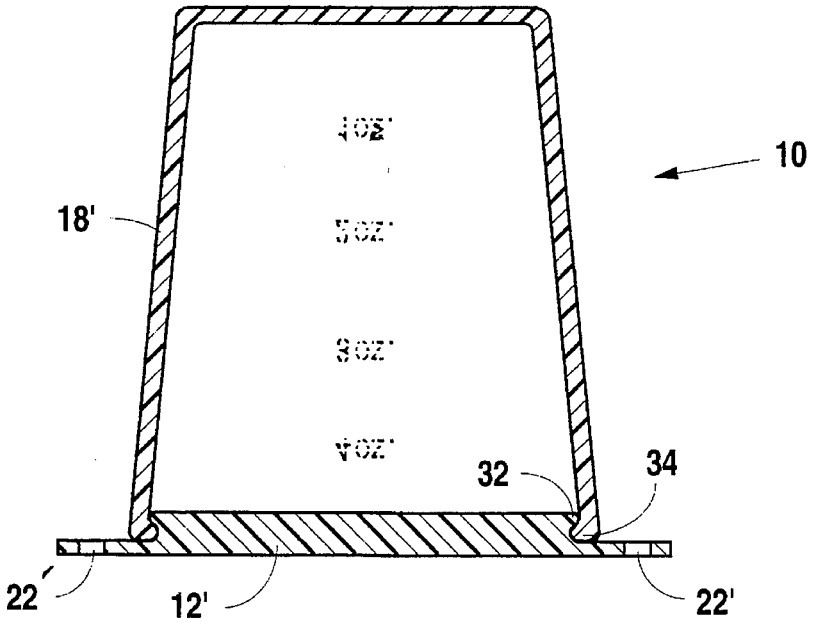
FIG. 7 is a cross-sectional view of the alternative arrangement of the device embodying the present invention shown in FIG. 6.

Alternatively, the volumetric measuring device 18 may be separately formed apart from the base, or body portion, on which the indicants 14 are disposed. For example, as shown in FIGS. 6 and 7, the measuring cup 18' may be inverted with the open top of the measuring cup removably attached to the body portion 12'. In this arrangement, the body portion 12' becomes a mounting base for the measuring cup 18'. The body portion 12' has a planar bottom surface and is essentially planar in structure with the exception of a raised lip 32 that may be formed as separate raised tabs, a continuous raised ridge or, as shown in FIG. 7, be formed on the outer edge surface of a centrally disposed raised or stepped area. The lip 32 is shaped to at least partially abut and frictionally engage the inner surface, or rim, 34 of the open end of the cup 18'. Alternatively, the lip 32 may be disposed on the inner peripheral edge surface of a raised flange area of the body portion 12' by which arrangement an inwardly facing lip snaps over, i.e. frictionally engages, an outer surface of the rim of the cup 18'. Also, the removable attachment of the measuring cup 18' to body portion 12' may be provided by mating threads, or tabs and grooves, formed respectively in selected internal or external rim surfaces of the cup 18' and the engagement lip provided on the base 12'.

Importantly, the apertures 22' and the means 16' associated with each of the indicants for selectively attaching the assembled indicating device 10 to a container are provided in the peripheral region of the body portion 12'. This arrangement advantageously positions the apertures 22' and the attachment means 16' outside the central area of the body portion 12' at a location where each attachment means can be visually associated, unambiguously, with a single one of the indicants 14. As in the earlier arrangement, the preselected indicants 14 may be conveniently formed on the bottom surface of the body portion 12'. In either arrangement, the volumetric measuring utensil 18,18' and the body portion 12,12' may have a shape other than the circular shape illustrated in the drawings.

Figure 4:
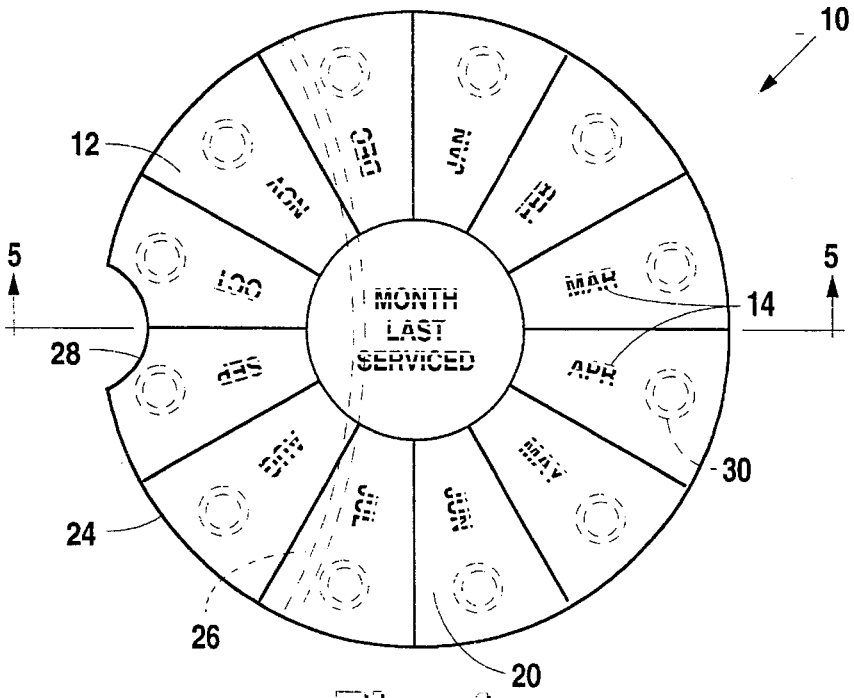
FIG. 4 is a plan view of the body portion of another alternate arrangement of the indicating device embodying the present invention.
Figure 5:
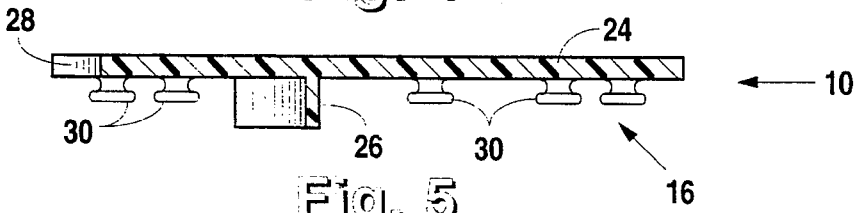
FIG. 5 is a sectional view taken along the line 5—5 in FIG. 4.

Another example of an indicating device 10 embodying the present invention is shown in FIGS. 4 and 5. In this example, the indicating device 10 is essentially a flexible flat disk 24 having a curved lip 26 extending angularly from the bottom of the disk, and a curved notch 28 at one edge of the disk. The top and bottom edges of the disk, as viewed in FIG. 4, may be bent upwardly to form a curved trough to direct fluid, such as oil, through a filler opening in an engine or machine. When bent, the curved lip is deformed to a smaller radius, and when inserted into a hole having a diameter less than the free shape of the lip, expands outwardly into biased contact with the side of the opening. This spring-like action retains the disk 24 in its flexed, or bent, shape, with the right side of the disk, as viewed in FIG. 5, at a higher elevation than the left, or notched side, thereby forming a trough-shaped channel to guide the flow of fluid toward the notch and into the opening. As can be appreciated, in this arrangement the indicating device 10 is useful for controlling spills and drips when adding, or replacing, fluids and simultaneously indicating the time, e.g., date, day, week, month or year, when the fluid was added or replaced. Furthermore, this embodiment of the present invention may be suitably attached to an oil or hydraulic fluid dip stick or similar volumetric measuring utensils on an engine or machine.

An alternate means 16 associated with each of the indicants 14 for selectively attaching the indicating device 10 to a container is indicated by hidden lines in FIG. 4 and in solid detail in FIG. 5. In this embodiment, the attachment means 16 includes a mechanical button-type snap connector, with a male portion 30 of the snap being permanently attached in close proximity to each of the indicants 14. As best shown in FIG. 4, the snap member 30 may be placed immediately under, or on the opposite side of, each of the predefined surface areas 20 associated with a respective one of the indicating marks 14. In this arrangement, the snap connector is attached to the container, and the characteristics of the contents of the container are indicated by attaching the female portion of the connector to a selected one of the male portions 30. Alternatively, a plurality of the female portions of the connector could be mounted on the indicating device 10 and the single male portion connected to the container.

In a similar manner, the means 16 associated with each of the indicants 14 for selectively identifying the characteristics of the contents of a container may be a conventional matable clasp, such as a mechanical spring-closure hook, a hook-and-loop fabric fastener, or other known fastening device. However, whichever fastening device is used, it is essential that indicating device 10 be capable of being selectively attached to the container in such a manner that the attachment point, or position, of the indicating device 10 be unambiguously associated with only a single one of the identifying marks 14.

The indicating device 10 embodying the present invention may also be used to indicate an operational characteristic of an article itself, such as whether or not it is "in service", "out of service", on "standby", the next service date, or other operational state. In this embodiment, the indicants 14 on the body portion 12 would accordingly separately identify the predefined operational characteristics or states and have a means 16 associated with each of the separate indicants 14.

Industrial Applicability

The present invention provides an effective and economical tool for selectively identifying the contents, or a characteristic of the contents, of a container. The indicating device 10 is preferably assembled, or integrally formed, with a measuring utensil 18, a flow control utensil such as a funnel or deformable flow guide member 26, or other utensil or tool that may be used in conjunction with opening, measuring, mixing or handling of the contents of the container.

An important feature of the present invention is the ability of the indicating device 10 to selectively identify content characteristics simply by the position of the device 10 when it attached to the container. The attachment position may be selectively changed to indicate a different characteristic if the contents of the container are changed, or if the indicating device 10 is moved to a container having different contents.

The present invention also provides an effective and economical method for indicating the operating status or other characteristic of an article. For example, it is often desirable to indicate whether a particular machine, tool, or vehicle is operable, out of service, on standby, or due for service at a future time. In this embodiment, the indicating device 10 has a plurality of appropriate messages marked adjacent a corresponding plurality of means for attaching the device 10 to an article.

Importantly, the indicating device 10 embodying the present invention is easily formable of inexpensive, readily moldable or stamped plastic or metallic materials.

Other aspects, features and advantages of the present invention can be obtained from a study of this disclosure together with the appended claims.

What is claimed is:

1. A device for selectively indicating a characteristic of the contents of a container, comprising:

a volumetric measuring utensil having measuring indicia disposed thereon;

a body portion consisting essentially of a single planar structure and having a plurality of predefined indicants disposed thereon, said body portion being fixedly connected to said measuring utensil; and a means associated with each of said indicants for selectively attaching said device to said container.

2. A device, as set forth in claim 1, wherein said body portion is integrally formed with said measuring utensil.

3. A device for selectively indicating a characteristic of the contents of a container, comprising:

a volumetric measuring utensil having measuring indicia disposed thereon;

a body portion having a substantially planar surface with a plurality of predefined indicants disposed thereon, said body portion being removably attached to said measuring utensil; and means associated with each of said indicants for selectively attaching said device to said container, said means being disposed at a peripheral region of said planar body portion.

4. A device, as set forth in claim 3, wherein said body portion has a raised lip and said volumetric measuring utensil has a rim disposed at an open end of the utensil, said lip being adapted to engage said rim and maintain the volumetric measuring utensil in a fixed but selectively separable relationship with said body portion, and said attachment means being disposed peripherally outwardly of said lip.

* * * * *